US008154223B2

(12) United States Patent
Hsu et al.

(10) Patent No.: US 8,154,223 B2
(45) Date of Patent: Apr. 10, 2012

(54) DRIVING APPARATUS OF LIGHT EMITTING DIODE AND DRIVING METHOD THEREOF

(75) Inventors: Kuo-Ching Hsu, Hsinchu (TW); Chin-Hsun Hsu, Taipei County (TW); Tsung-Hau Chang, Hsinchu (TW); Ting-Wei Liao, Taipei County (TW)

(73) Assignee: Novatek Microelectronics Corp., Hsinchu (TW)

( * ) Notice: Subject to any disclaimer, the term of this patent is extended or adjusted under 35 U.S.C. 154(b) by 309 days.

(21) Appl. No.: 12/628,233

(22) Filed: Dec. 1, 2009

(65) Prior Publication Data

US 2011/0062887 A1 Mar. 17, 2011

(30) Foreign Application Priority Data

Sep. 16, 2009 (TW) ..... 98131241 A

(51) Int. Cl.
*H05B 37/02* (2006.01)

(52) U.S. Cl. ..... 315/360; 315/291; 315/294; 315/312; 315/302; 345/690; 345/691; 345/204; 345/42

(58) Field of Classification Search ..... 315/291, 315/294, 297, 169.1, 185 R, 307, 360, 312, 315/287; 345/46, 82, 63, 204, 211, 212, 345/207, 690, 691

See application file for complete search history.

(56) References Cited

U.S. PATENT DOCUMENTS

| | | | | |
|---|---|---|---|---|
| 7,560,677 | B2 * | 7/2009 | Lyons et al. | 250/205 |
| 7,659,873 | B2 * | 2/2010 | Nakao et al. | 345/82 |
| 7,764,028 | B2 * | 7/2010 | Mariyama et al. | 315/360 |
| RE42,161 | E * | 2/2011 | Hochstein | 363/89 |
| 7,999,484 | B2 * | 8/2011 | Jurngwirth et al. | 315/247 |
| 2009/0184662 | A1 * | 7/2009 | Given et al. | 315/294 |
| 2010/0148679 | A1 * | 6/2010 | Chen et al. | 315/185 R |
| 2011/0018450 | A1 * | 1/2011 | Hsu et al. | 315/185 R |

* cited by examiner

*Primary Examiner* — Haiss Philogene
(74) *Attorney, Agent, or Firm* — Jianq Chyun IP Office

(57) ABSTRACT

A driving apparatus of a light emitting diode (LED) and a driving method thereof are provided. In the driving method, when the driving apparatus performs dimming and a duty cycle of a dimming signal is smaller than a predetermination value, outputting time of driving currents are equally allotted in a period, and a magnitude of each driving current is regulated correspondingly. When the driving apparatus performs dimming and the duty cycle of the dimming signal is equal to or greater than the predetermination value, the driving currents are simultaneously output in the period, and the magnitude of each driving current is regulated according to the dimming signal. Therefore, an audio noise and an electromagnetic interference caused by excessive variation of a sum of the driving currents are suppressed.

22 Claims, 11 Drawing Sheets

DRIVING APPARATUS OF LIGHT EMITTING DIODE AND DRIVING METHOD THEREOF

CROSS-REFERENCE TO RELATED APPLICATION

This application claims the priority benefit of Taiwan application serial no. 98131241, filed on Sep. 16, 2009. The entirety of the above-mentioned patent application is hereby incorporated by reference herein and made a part of this specification.

BACKGROUND OF THE INVENTION

1. Field of the Invention

The present invention relates to a driving method. More particularly, the present invention relates to a driving apparatus of a light-emitting diode and a driving method thereof.

2. Description of Related Art

Light emitting diodes (LEDs) have advantages of small size, power-saving and high durability, and as fabrication processes thereof become mature, price of the LEDs decreases. Therefore, it is popular to use the LEDs as light source products. Moreover, since the LED has features of low-operating voltage (only 1.5-3V), initiative light-emitting, and having a certain brightness, wherein the brightness can be adjusted by voltage or current, and has features of impact resistance, anti-vibration and long lifespan (100,000 hours), the LED is widely used to various terminal equipments, such as vehicle headlamps, traffic lights, text displays, billboards and large screen video displays, and domains such as general level architectural lighting and liquid crystal display (LCD) backlight, etc.

Regarding a driving circuit of the LED, a commonly used dimming method thereof is to regulate a duty cycle of a pulse according to a pulse-width modulation (PWM) technique, so as to regulate an equivalent current output to the LED by an output stage to adjust a brightness of the LED. However, when the PWM technique is used for dimming, a current switching operation of the output stage is the same as that of a switch. The current switching operation lead to a great load variation of a voltage of the output stage, so that the voltage may have an excessive ripple. Meanwhile, the excessive ripple can cause a great magnetic field variation of an inductor in the circuit, and a capacitor in the circuit can be sharply vibrated to generate a shape-changing due to an excessive transient voltage variation, so that an audio noise is generated.

FIG. 1A is a system schematic diagram illustrating a conventional driving circuit of an LED. Referring to FIG. 1A, the driving circuit 100 includes a voltage converter 110, a conversion loop controller 120, an amplifier 130, a voltage selector 140 and a current driving unit 150 formed by a plurality of current driving devices. The voltage converter 110 receives a power voltage $V_{DD}$, and generates an operating voltage $V_{CC}$ with a level different to that of the power voltage $V_{DD}$ according to an output of the conversion loop controller 120. A positive input terminal of the amplifier 130 receives a reference voltage Vref, and a negative input terminal thereof receives an output voltage of the voltage selector 140, so that the amplifier 130 accordingly outputs a voltage to control the conversion loop controller 120, wherein the reference voltage Vref is a fixed value. The voltage selector 140 selects and outputs a voltage of a negative terminal of one of LED strings 50_1-50_*n*. Positive terminals of the LED strings 50_1-50_*n* receive the operating voltage $V_{CC}$, and the negative terminals of the LED strings 50_1-50_*n* are respectively coupled to the current driving unit 150 through switches S1-Sn. The LED strings 50_1-50_*n* are driven by load currents $i_1$-$i_n$, and the switches are switched according to a dimming signal, so as to implement a dimming operation.

FIG. 1B is a timing diagram of the driving currents of FIG. 1A. Referring to FIG. 1A and FIG. 1B, in the LED driving circuit 100, the PWM technique is generally used to regulate a time $t_1$ for supplying the load currents $i_1$-$i_n$, so as to adjust the brightness of the LED. In other words, in a fixed period T, the longer the time $t_1$ is, the higher the brightness of the LED is. Conversely, the shorter the time $t_1$ is, the lower the brightness of the LED is. However, when the PWM technique is used for dimming, switching operations of the switches S1-Sn lead to a variation of the load currents $i_1$-$i_n$, and the variation of the load currents $i_1$-$i_n$ can lead to a great load variation of the operating voltage $V_{CC}$, so that the operating voltage $V_{CC}$ output by the voltage converter 110 may have an excessive ripple. Meanwhile, an input current of the voltage converter 100 may also have a great transient variation, which may not only cause a great magnetic field variation of an inductor in the voltage converter 100, but also a regulation capacitor in the voltage converter 100 can be sharply vibrated to generate a shape-changing due to an excessive transient voltage variation, so that the audio noise is generated. Moreover, regarding the driving circuit 100, during the dimming, the switches S1-Sn are simultaneously switched to switch the load currents $i_1$-$i_n$, though the current switching operation can cause a severe electromagnetic interference (EMI).

SUMMARY OF THE INVENTION

The present invention is directed to a driving apparatus of a light-emitting diode (LED) and a driving method thereof, which can suppress an audio noise and an electromagnetic interference (EMI).

The present invention provides a driving method of an LED, which is adapted to a driving apparatus. The driving method includes following steps. First, a dimming signal is received. Next, when the driving apparatus performs dimming according to the dimming signal, outputting time of a plurality of driving currents are equally allotted in a period. Next, the driving currents are output to respectively drive a plurality of LEDs. The step of equally allotting the outputting time of the driving currents in the period includes equally allotting the outputting time of the driving currents in the period and correspondingly regulating a current magnitude of each of the driving currents when the driving apparatus performs the dimming and a duty cycle of the dimming signal is smaller than a predetermined value.

The present invention provides a driving method of an LED, which is adapted to a driving apparatus. The driving apparatus receives a dimming signal, and outputs a plurality of driving currents to respectively drive a plurality of LEDs. The driving method includes following steps. First, it is detected whether the driving apparatus performs dimming. Next, when the driving apparatus performs the dimming and a duty cycle of the dimming signal is smaller than a predetermined value, outputting time of the driving currents are equally allotted in a period, and a current magnitude of each of the driving currents is correspondingly regulated. Next, when the driving apparatus performs the dimming and the duty cycle of the dimming signal is equal to or greater than the predetermined value, the driving currents are simultaneously output in the period, and the current magnitude of each of the driving currents is regulated according to the dimming signal.

The present invention provides a driving apparatus of an LED, which includes a current driving unit, a plurality of switches, a dimming detector and a current control unit. The current driving unit outputs a plurality of driving currents to respectively drive a plurality of LEDs. The switches are respectively coupled between the current driving unit and the LEDs for controlling whether or not to output the driving currents to the LEDs. The dimming detector receives a dimming signal, and detects whether the driving apparatus performs dimming according to the dimming signal, so as to output a dimming mode signal. The current control unit is coupled to the dimming detector and the switches. When the driving apparatus performs the dimming, the current control unit controls conducting time of the switches to be equivalent in a period and equally divide the period according to the dimming mode signal.

The present invention provides a driving apparatus of an LED, which includes a current driving unit, a plurality of switches, a dimming detector and a current control unit. The current driving unit outputs a plurality of driving currents to respectively drive a plurality of LEDs. The switches are respectively coupled between the current driving unit and the LEDs for controlling whether or not to output the driving currents to the LEDs. The dimming detector receives a dimming signal, and detects whether the driving apparatus performs dimming and whether a duty cycle of the dimming signal is smaller than a predetermined value according to the dimming signal, and accordingly outputs a dimming mode signal. The current control unit is coupled to the dimming detector, the switches and the current driving unit. When the driving apparatus performs the dimming and the duty cycle of the dimming signal is smaller than the predetermined value, the current control unit controls conducting time of the switches to be equivalent in a period and equally divide the period according to the dimming mode signal, and controls the current driving unit to regulate a current magnitude of each of the driving currents. When the driving apparatus performs the dimming and the duty cycle of the dimming signal is equal to or greater than the predetermined value, the current control unit controls the switches to be simultaneously conducted in the period according to the dimming mode signal, and controls the current driving unit to regulate a current magnitude of each of the driving currents according to the dimming signal.

According to the driving apparatus of the LED of the present invention and the driving method thereof, when the driving apparatus performs the dimming and the duty cycle of the dimming signal is smaller than the predetermined value, the outputting time of the driving currents are equally allotted in a period, and the current magnitude of each of the driving currents is correspondingly regulated. When the driving apparatus performs the dimming and the duty cycle of the dimming signal is equal to or greater than the predetermined value, the driving currents are simultaneously output in the period, and the current magnitude of each of the driving currents is regulated according to the dimming signal. By such means, the audio noise and the EMI caused by excessive variation of a sum of the driving currents are suppressed.

In order to make the aforementioned and other features and advantages of the present invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

FIG. 2I is still another schematic diagram illustrating a current control unit and a dimming detector of FIG. 2A.

DESCRIPTION OF THE EMBODIMENTS

Figure 1A:
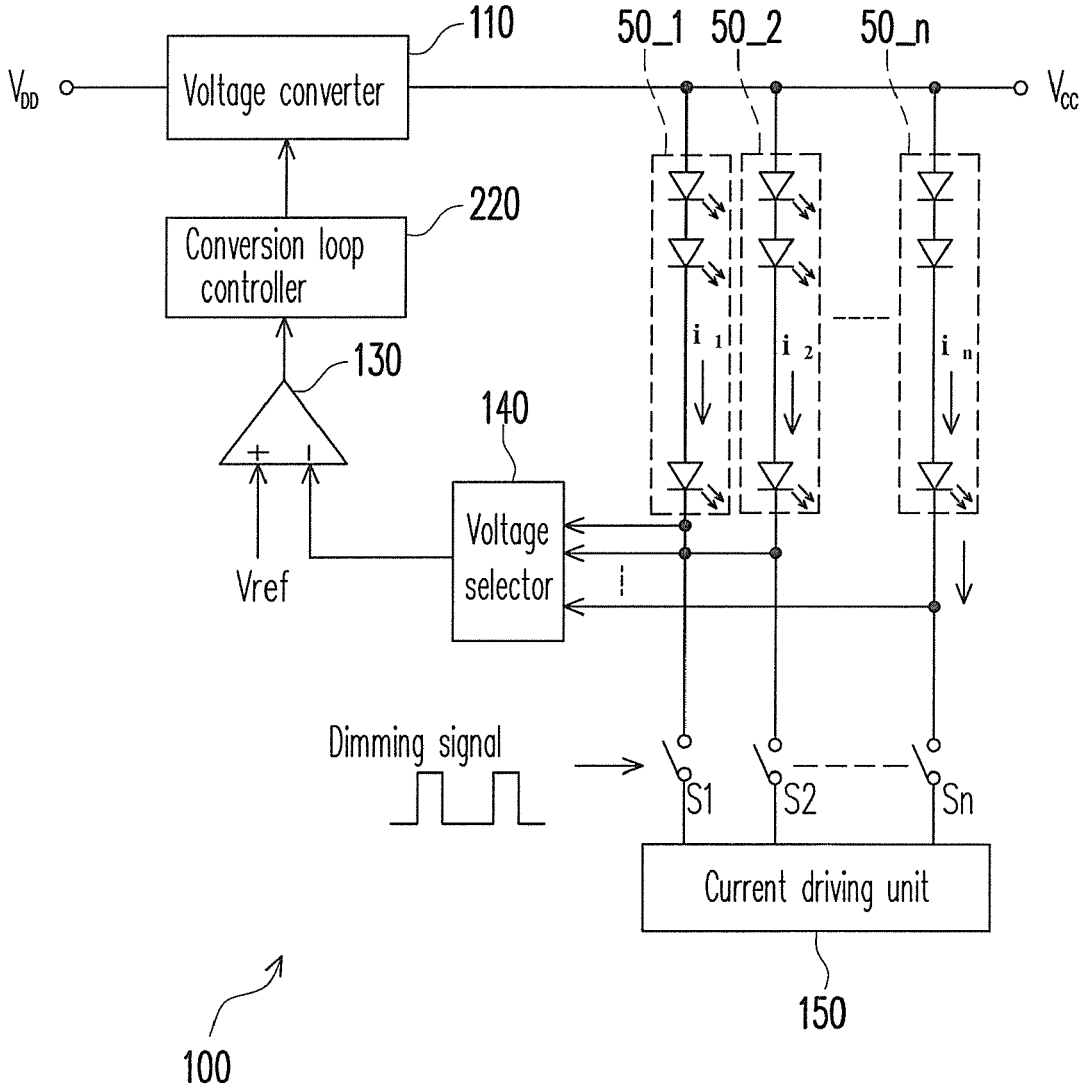
FIG. 1A (RELATED ART)
FIG. 1A is a system schematic diagram illustrating a conventional driving circuit of an LED.
Figure 1B:
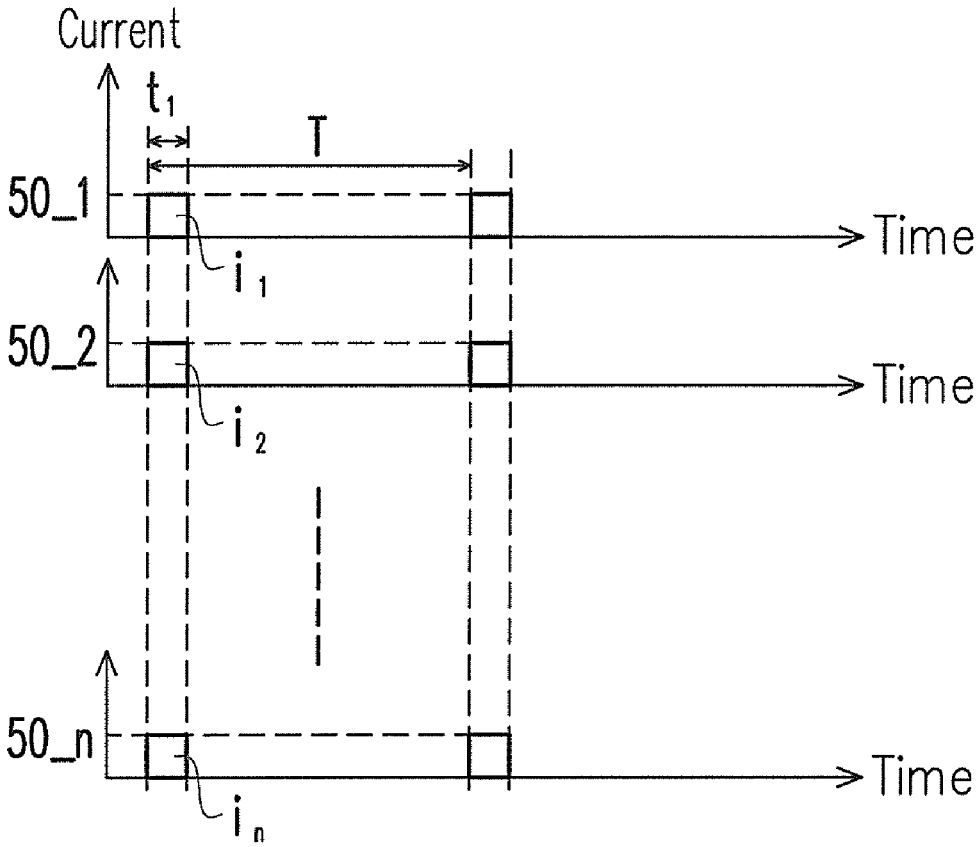
FIG. 1B (RELATED ART)
FIG. 1B is a timing diagram of driving currents of FIG. 1A.

Reference will now be made in detail to the present preferred embodiments of the invention, examples of which are illustrated in the accompanying drawings. Wherever possible, the same reference numbers are used in the drawings and the description to refer to the same or like parts.

Figure 2A:
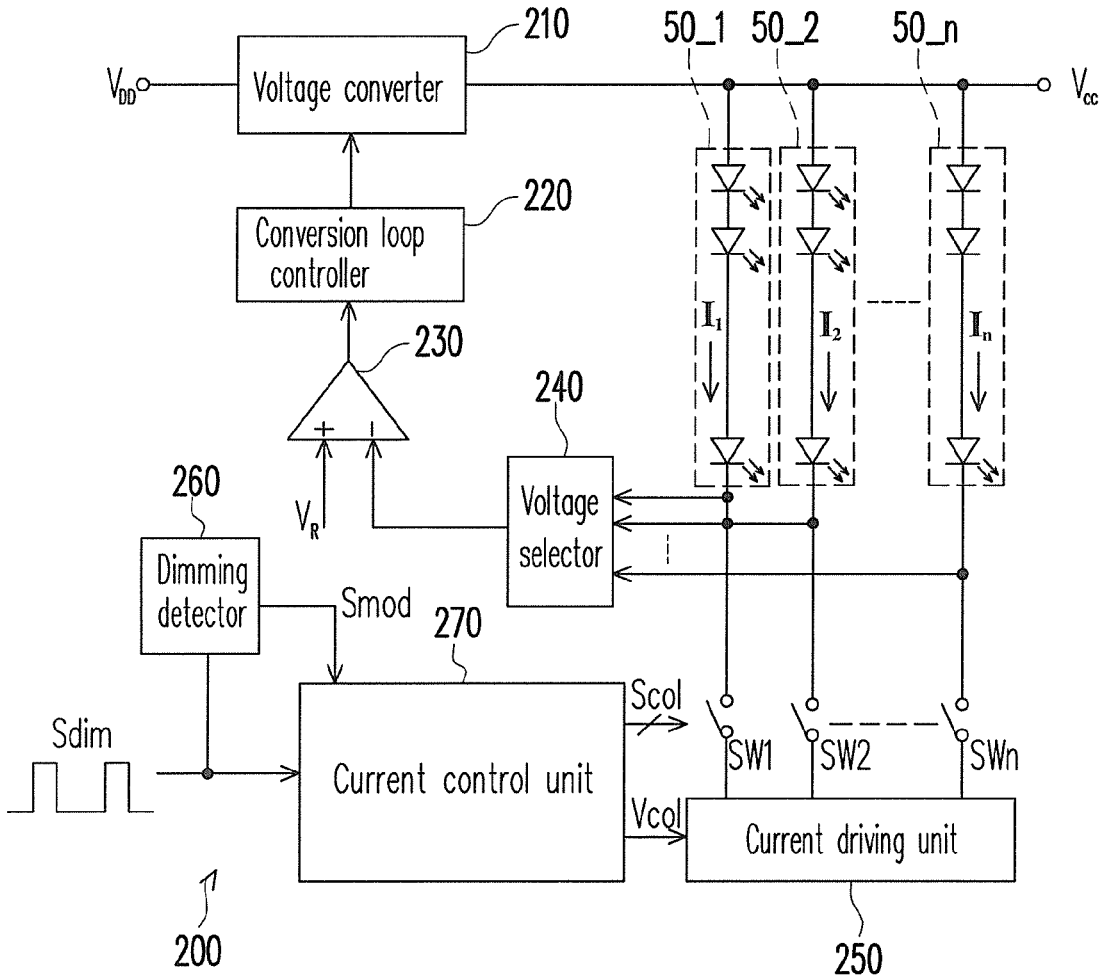
FIG. 2A is a schematic diagram illustrating a driving circuit according to an embodiment of the present invention.

FIG. 2A is a schematic diagram illustrating a driving circuit according to an embodiment of the present invention. Referring to FIG. 2A, the driving circuit 200 includes a voltage converter 210, a conversion loop controller 220, an amplifier 230, a voltage selector 240, a current driving unit 250, a dimming detector 260, a current control unit 270 and switches SW1-SWn. The dimming detector 260 receives a dimming signal Sdim, and detects whether the driving apparatus 200 performs dimming according to the dimming signal Sdim, so as to output a dimming mode signal Smod. The current control unit 270 outputs a plurality of control signals Scol and a control voltage Vcol according to the dimming mode signal Smod and the dimming signal Sdim. The control signals Scol respectively control a conducting state of each of the switches SW1-SWn, and the control voltage Vcol controls the current driving unit 250 to regulate current magnitudes of driving currents $I_1$-$I_n$.

The voltage converter 210 receives a power voltage $V_{DD}$, and generates an operating voltage $V_{CC}$ with a level different to that of the power voltage $V_{DD}$ according to an adjusting signal output from the conversion loop controller 220. The conversion loop controller 220 generates the adjusting signal according to a received voltage. A positive input terminal of the amplifier 230 receives a reference voltage $V_R$, and a negative input terminal thereof receives a voltage output from the voltage selector 240, so that the amplifier 230 accordingly outputs a voltage to the conversion loop controller 220, wherein the reference voltage $V_R$ can be a fixed value. The voltage selector 240 selects and outputs a voltage of a negative terminal of one of light-emitting diode (LED) strings **50_1-50_*n*. Positive terminals of the LED strings 50_1-50_*n* receive the operating voltage $V_{CC}$, and the negative terminals of the LED strings 50_1-50_*n* are respectively coupled to the current driving unit 250 through the switches SW1-SWn. The LED strings 50_1-50**_*n* are driven by the driving currents $i_1$-$i_n$.

When a duty cycle of the dimming signal Sdim is 100%, it represents that the driving apparatus does not perform the dimming. Now, the current control unit 270 generates the control signals Scol according to the dimming mode signal Smod, so as to control the switches to be simultaneously conducted in a period, and control the current driving unit 250 to regulate a current magnitude D of each of the driving currents $I_1$-$I_n$ to a current upper limit according to the control voltage Vcol. When the duty cycle of the dimming signal Sdim is not 100%, it represents that the driving apparatus performs the dimming. Now, the current control unit 270 also generates the control signals Scol according to the dimming mode signal Smod, so as to control conducting time of the switches SW1-SWn to be equivalent in a period, and control the current driving unit 250 to regulate the current magnitudes of the driving currents $I_1$-$I_n$ according to the control voltage Vcol, wherein the current driving unit 250 can be formed by a plurality of voltage-controlled current sources, so as to simultaneously regulate the current magnitudes of the driving currents $I_1$-$I_n$ according to the control voltage Vcol. It should be noticed that a relationship between the duty cycle of the dimming signal Sdim and whether the driving apparatus 200 performs the dimming is only used as an example, which can be modified according to an actual requirement.

Figure 2B:
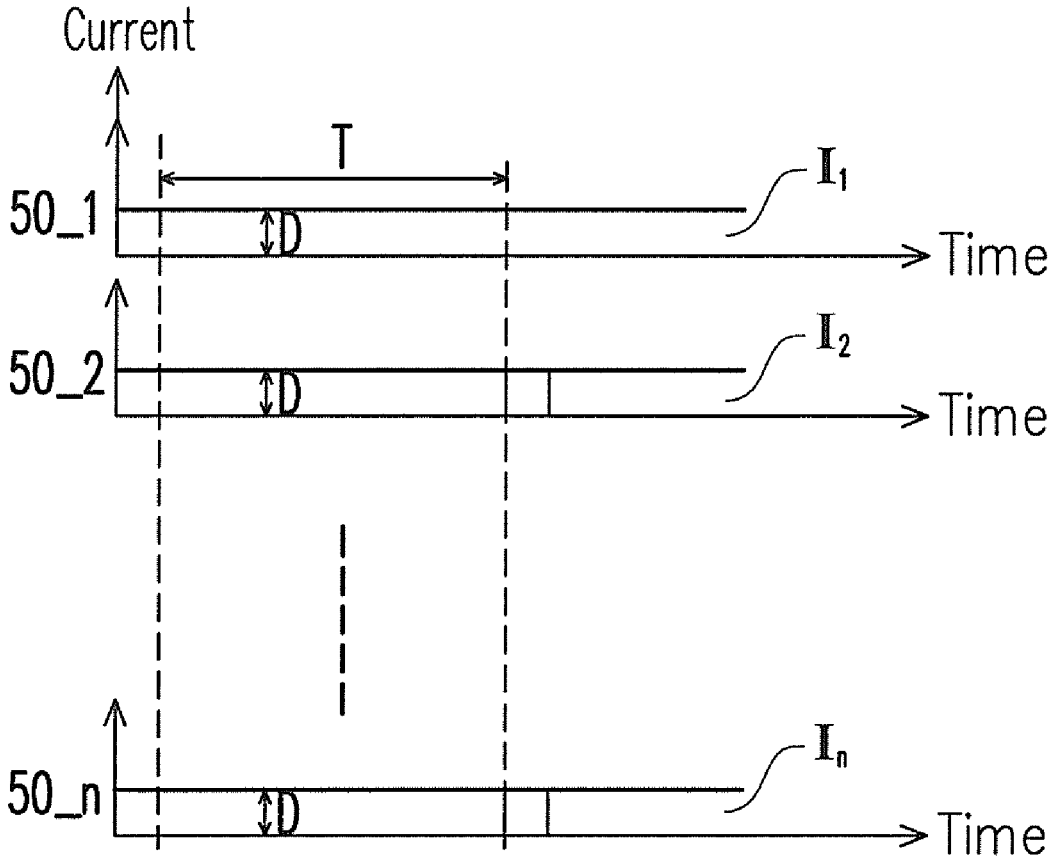
FIG. 2B is a current waveform diagram of LED strings of FIG. 2A.

The dimming operation of the driving apparatus 200 is further described below. FIG. 2B is a current waveform diagram of the LED strings of FIG. 2A. Referring to FIG. 2A and FIG. 2B, when the driving apparatus 200 performs the dimming and the duty cycle of the dimming signal Sdim is greater than or equal to a predetermined value, the current control unit 270 generates a plurality of the control signals Scol and the control voltage Vcol according to the dimming mode signal Smod and the dimming signal Sdim. The control signals Scol control the switches SW1-SWn to be simultaneously conducted in a period T, so as to simultaneously provide the driving currents $I_1$-$I_n$ to the LED strings 50_1-50_*n*. The currents on the LED strings 50_1-50_*n* present a direct current (DC) state rather than a pulse state due to that the switches SW1-SWn are maintained conducted. Moreover, the current driving unit 250 regulates the current magnitude D of each of the driving currents $I_1$-$I_n$ according to the control voltage Vcol, wherein the current magnitude D relates to the duty cycle of the dimming signal Sdim, for example, if the duty cycle is ⅛, the current magnitude D is equal to ⅛ of the current upper limit. The predetermined value can be a ratio between the period T and a number n of the driving currents $I_1$-$I_n$, for example, if the number n of the driving currents is 8, the predetermined value is then ⅛ of the period (i.e. T/8).

Figure 2C:
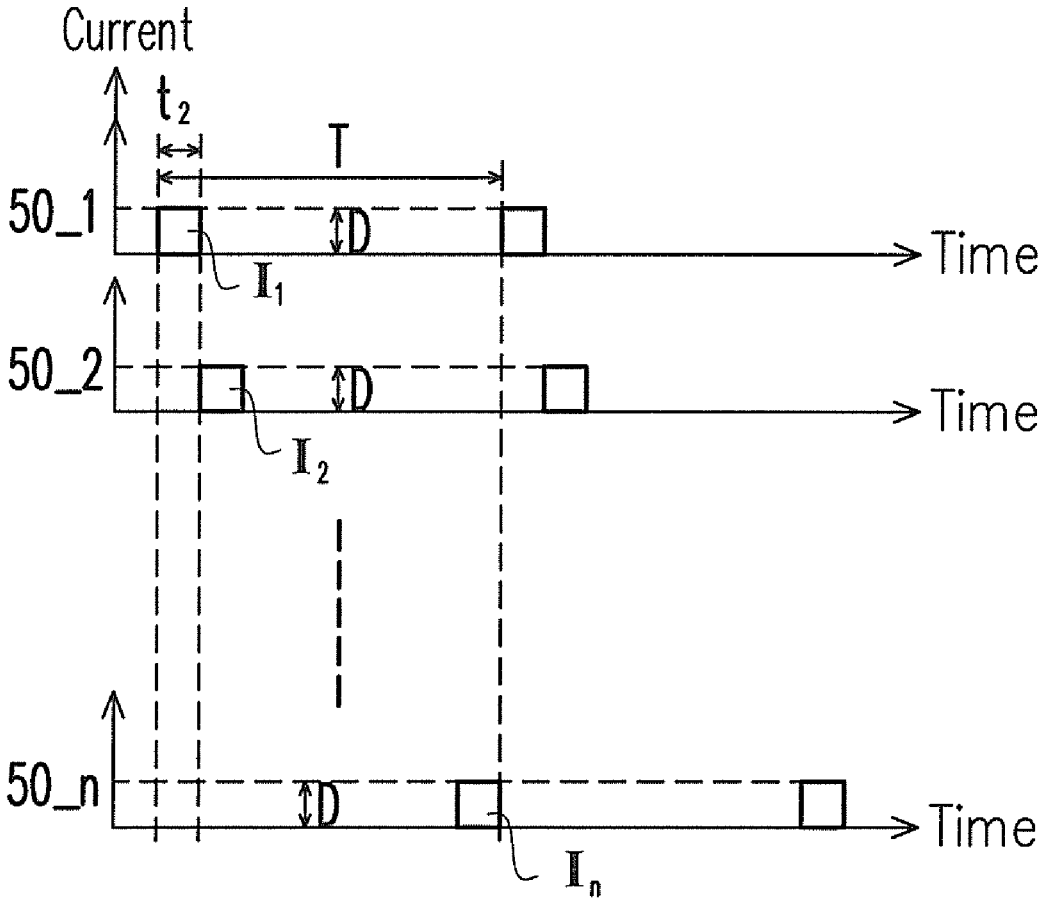
FIG. 2C is another current waveform diagram of LED strings of FIG. 2A.

FIG. 2C is another current waveform diagram of the LED strings of FIG. 2A. Referring to FIG. 2A and FIG. 2C, when the driving apparatus 200 performs the dimming and the duty cycle of the dimming signal Sdim is smaller than the predetermined value, the current control unit 270 also generates a plurality of the control signals Scol and the control voltage Vcol according to the dimming mode signal Smod and the dimming signal Sdim. The control signals Scol control conducting time $t_2$ of each of the switches SW1-SWn to be equivalent in the period T, so as to respectively output the driving currents $I_1$-$I_n$ to the LED strings 50_1-50_*n*. For example, if a number of the switches is 8, the conducting time $t_2$ is then ⅛ of the period T. The current driving unit 250 regulates the current magnitude D of each of the driving currents $I_1$-$I_n$ according to the control voltage Vcol, wherein the current magnitude D relates to the duty cycle of the dimming signal Sdim and the predetermined value, for example, if the duty cycle is 1/16, the current magnitude D is equal to ½ of the current upper limit, i.e. equal to the duty cycle (i.e. 1/16) divided by the predetermined value (i.e. ⅛) times the current upper limit. The driving currents $I_1$-$I_n$ can be sequentially output in turn or can be output in turn according to a random sequence.

Accordingly, regardless of the switches SW1-SWn being simultaneously or respectively conducted during the period T according to the duty cycle of the dimming signal Sdim, a sum of the driving currents $I_1$-$I_n$ is approximately maintained to a fixed value, which can greatly reduce or even eliminate a load variation of the operating voltage $V_{CC}$, so as to suppress an audio noise and an electromagnetic interference (EMI).

Figure 2D:
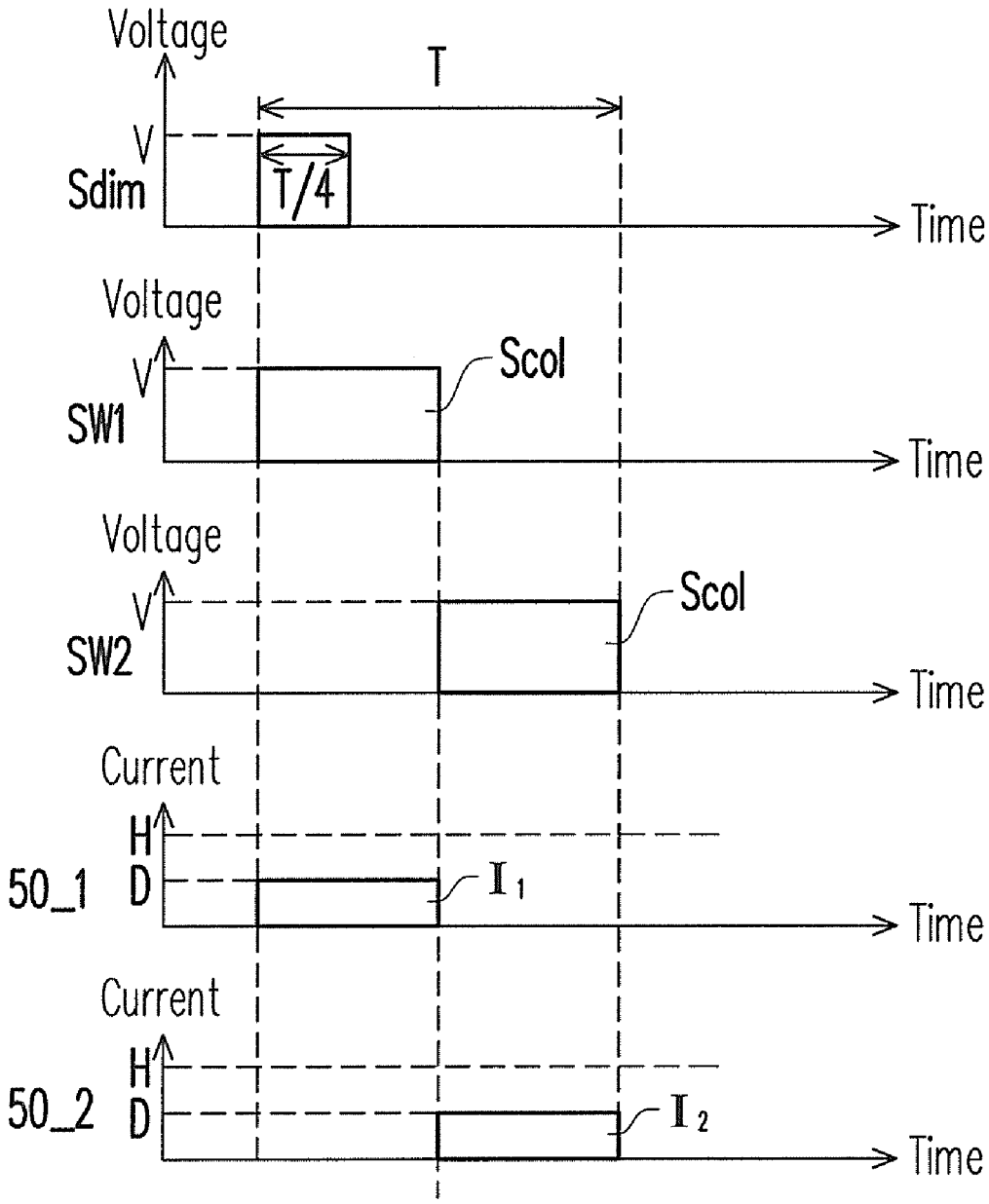
FIG. 2D is a waveform diagram of a driving apparatus and LED strings of FIG. 2A.

FIG. 2D is a waveform diagram of the driving apparatus and the LED strings of FIG. 2A. Referring to FIG. 2A and FIG. 2D, in the present embodiment, assuming the driving apparatus 200 only drives the LED strings 50_1 and 502, and the duty cycle of the received dimming signal Sdim is ¼. Now, the switches SW1 and SW2 are respectively conducted according to the received control signals Scol, and the conducting time thereof is respectively T/2. Moreover, the current driving unit 250 regulates the current magnitude D of each of the driving currents $I_1$-$I_n$ to a half (i.e. ½) of a current upper limit H according to the control voltage Vcol, wherein the current upper limit H corresponds to a high level V of the voltage signal. Accordingly, the driving apparatus 200 can implement a ¼ dimming effect, and the current magnitude D is approximately maintained to a half of the current upper limit H, so as to suppress the audio noise and the EMI.

Figure 2E:
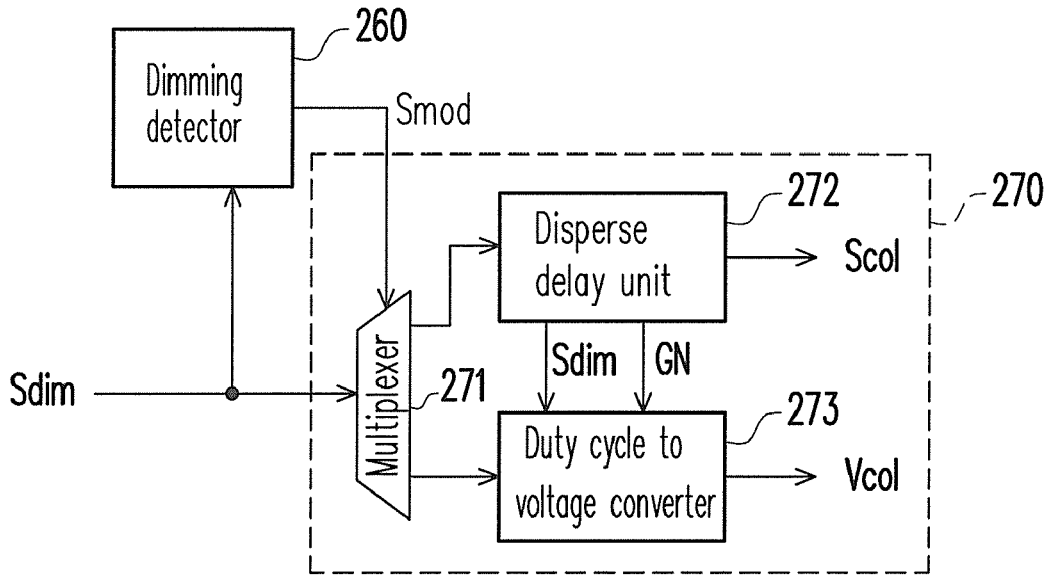
FIG. 2E is a schematic diagram illustrating a current control unit and a dimming detector of FIG. 2A.

FIG. 2E is a schematic diagram illustrating the current control unit and the dimming detector of FIG. 2A. Referring to FIG. 2E, in the present embodiment, the current control unit 270 includes a multiplexer 271, a disperse delay unit 272 and a duty cycle to voltage converter 273. When the driving apparatus 200 performs the dimming and the duty cycle of the dimming signal Sdim is greater than or equal to the predetermined value, under a control of the dimming mode signal Smod output from the dimming detector 260, a first output terminal of the multiplexer 271 outputs the dimming signal Sdim received by an input terminal thereof to the duty cycle to voltage converter 273, so as to regulate a magnitude of the control voltage Vcol according to the duty cycle of the dimming signal Sdim. The current driving unit 250 synchronously regulates the current magnitudes of the driving currents $I_1$-$I_n$ according to a magnitude of the control voltage Vcol. Meanwhile, since the disperse delay unit 272 does not receive the dimming signal Sdim, the control signals of the disperse delay unit 272 control the switches SW1-SWn to be simultaneously conducted, so as to simultaneously output the driving currents $I_1$-$I_n$ to the LED strings 50_1-50_*n*.

When the driving apparatus 200 performs the dimming and the duty cycle of the dimming signal Sdim is smaller than the predetermined value, under a control of the dimming mode signal Smod output from the dimming detector 260, a second output terminal of the multiplexer 271 outputs the dimming signal Sdim received by the input terminal thereof to the disperse delay unit 272. After the disperse delay unit 272 receives the dimming signal Sdim, the controls signals Scol generated by the disperse delay unit 272 control the switches SW1-SWn to be respectively conducted during the period, wherein the conducting time of each of the switches SW1-SWn is identical. Generally, the control signals Scol can separately transmit pulses to conduct the switches SW1-SWn at different time sections. The conducting time of the switches SW1-SWn are separated and consecutive, i.e. the pulses used for conducting the switches are consecutively output from the corresponding output terminals of the control signals Scol, and a consecutive output effect thereof is equivalent to a pulse shifting effect. Wherein, the pulse shifting effect can be implemented by shift registers, namely, the function that the control signals Scol transmit the pulses at different time sections can be implemented by shifting and outputting the pulses through a plurality of the shift registers.

Meanwhile, the disperse delay unit 272 transmits the received dimming signal Sdim to the duty cycle to voltage converter 273, and simultaneously outputs a gain signal GN to the duty cycle to voltage converter 273. The duty cycle to voltage converter 273 regulates the magnitude of the control voltage Vcol according to the duty cycle of the dimming signal Sdim and the gain signal GN, so as to synchronously regulate the magnitudes of the driving currents $I_1$-$I_n$. Wherein, the gain signal GN can transmit a gain, and the gain transmitted by the gain signal GN can be equal to a current number of the driving currents $I_1$-$I_n$. For example, if the current number of the driving currents $I_1$-$I_n$ is 8, the gain transmitted by the gain signal GN is 8. For example, when the duty cycle of the dimming signal Sdim is 1/16, the current magnitude of each of the driving currents $I_1$-$I_n$ should be 1/16 of the current upper limit, though according to the gain signal GN, the current magnitude of each of the driving currents $I_1$-$I_n$ is adjusted to be 1/2 of the current upper limit, and since the outputting time of each of the driving currents $I_1$-$I_n$ is 1/8 of the period, a 1/16 dimming effect can be achieved.

It should be noticed that when the disperse delay unit 272 does not receive the dimming signal Sdim, the disperse delay unit 272 can output the gain signal GN with a gain of 1, or does not output the gain signal GN. Moreover, when the duty cycle to voltage converter 273 does not receive the gain signal GN, it can generate the corresponding control voltage Vcol according to the duty cycle of the dimming signal Sdim.

Figure 2F:
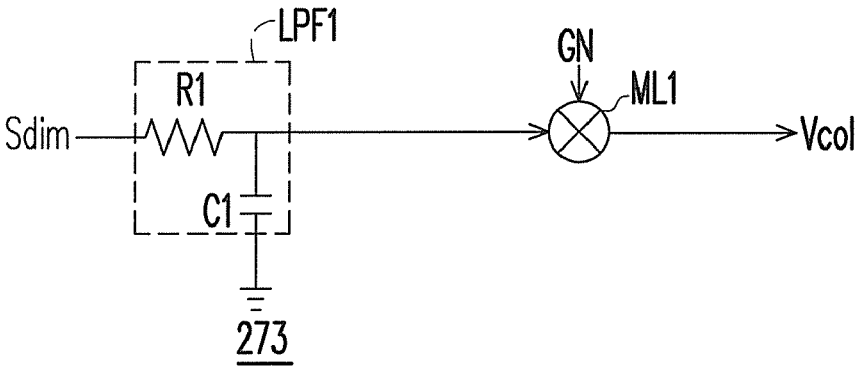
FIG. 2F is a schematic diagram illustrating a duty cycle to voltage converter of FIG. 2E.

FIG. 2F is a schematic diagram illustrating the duty cycle to voltage converter of FIG. 2E. Referring to FIG. 2F, in the present embodiment, the duty cycle to voltage converter 273 includes a low pass filter circuit LPF1 and an analog multiplier ML1, wherein the low pass filter circuit LPF1 can be formed by a resistor R1 and a capacitor C1, though the present invention is not limited thereto. The low pass filter circuit LPF1 can convert the received dimming signal Sdim into a DC level, i.e. the low pass filter circuit LPF1 can output different DC levels according to different duty cycles of the dimming signal Sdim. The analog multiplier ML1 can amplify the DC level output from the low pass filter circuit LPF1 to serve as the control voltage Vcol according to the gain signal GN. When the gain transmitted by the gain signal GN is 1, a level of the control voltage Vcol is the same to the DC level output by the low pass filter circuit LPF1. When the gain transmitted by the gain signal GN is 2, the level of the control voltage Vcol is twice of the DC level output by the low pass filter circuit LPF1, and the others are deduced by analogy.

Figure 2G:
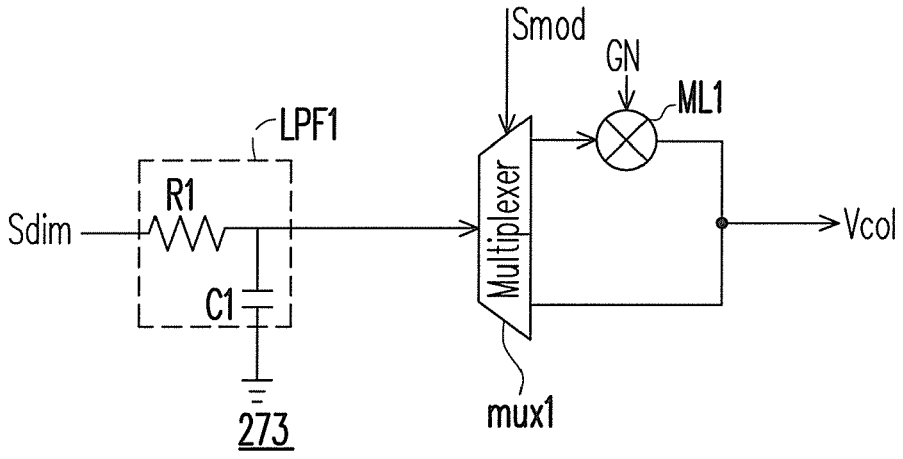
FIG. 2G is another schematic diagram illustrating a duty cycle to voltage converter of FIG. 2E.

FIG. 2G is another schematic diagram illustrating the duty cycle to voltage converter of FIG. 2E. Referring to FIG. 2F and FIG. 2G, a difference there between lies in a multiplexer mux1. The multiplexer mux1 determines whether to transmit the DC level output from the low pass filter circuit LPF1 to the analog multiplier ML1 or directly output the DC level according to the dimming mode signal Smod. In other words, when the driving apparatus 200 performs the dimming, and the duty cycle of the dimming signal Sdim is greater than or equal to the predetermined value, the DC level output by the low pass filter circuit LPF1 is directly output as the control voltage Vcol. When the driving apparatus 200 performs the dimming, and the duty cycle of the dimming signal Sdim is smaller than the predetermined value, the DC level output by the low pass filter circuit LPF1 is transmitted to the analog multiplier ML1, so as to be amplified according to the gain signal GN and output as the control voltage Vcol.

Figure 2H:
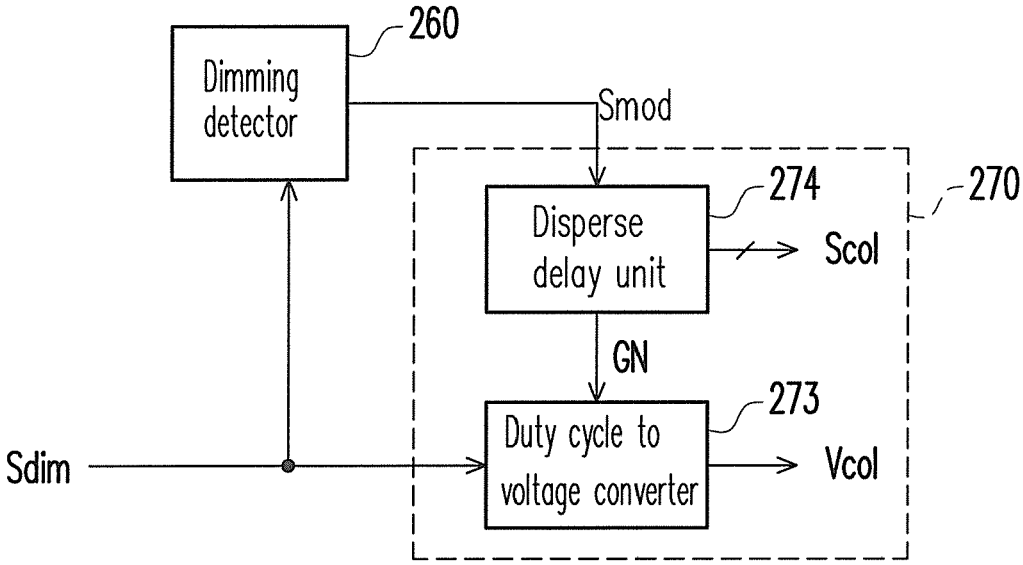
FIG. 2H is another schematic diagram illustrating a current control unit and a dimming detector of FIG. 2A.
Figure 21:
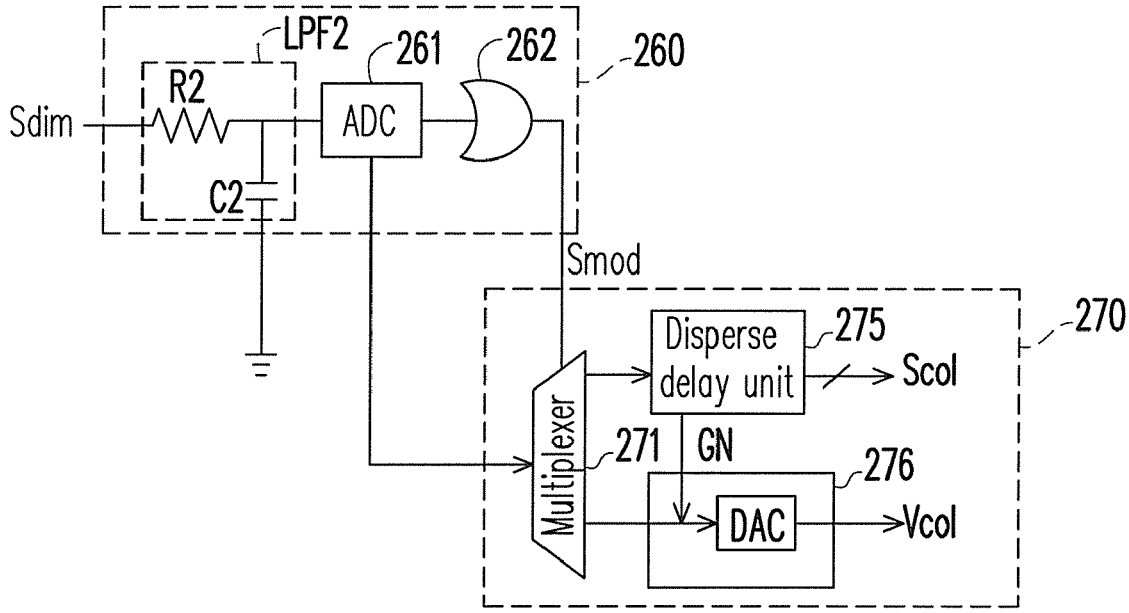

FIG. 2H is another schematic diagram illustrating the current control unit and the dimming detector of FIG. 2A. Referring to FIG. 2E and FIG. 2H, differences there between lie in the disperse delay unit 274 and the omitted multiplexer 271. When the driving apparatus 200 performs the dimming, and the duty cycle of the dimming signal Sdim is greater than or equal to the predetermined value, the disperse delay unit 274 generates the control signals Scol according to the dimming mode signal Smod, so as to control the switches SW1-SWn to be simultaneously conducted, wherein the disperse delay unit 274 does not output the gain signal GN or outputs the gain signal GN with the gain of 1. In case that the disperse delay unit 274 does not output the gain signal GN, the duty cycle to voltage converter 273 can generate the control voltage Vcol according to the received dimming signal Sdim. In case that the disperse delay unit 274 outputs the gain signal GN with the gain of 1, the duty cycle to voltage converter 273 can generate the control voltage Vcol according to the received dimming signal Sdim and the gain signal GN.

When the driving apparatus 200 performs the dimming, and the duty cycle of the dimming signal Sdim is smaller than the predetermined value, the disperse delay unit 274 generates the control signals Scol according to the dimming mode signal Smod, so as to control the switches SW1-SWn to be respectively conducted in one period, and the disperse delay unit 274 outputs the gain signal GN corresponding to the current number of the driving currents $I_1$-$I_n$. The duty cycle to voltage converter 273 can generate the control voltage Vcol according to the received dimming signal Sdim and the gain signal GN.

FIG. 2I is still another schematic diagram illustrating the current control unit and the dimming detector of FIG. 2A. Referring to FIG. 2I, the current number of the driving currents $I_1$-$I_n$ is, for example, 8, i.e. the predetermined value is 1/8. The dimming detector 260 includes a low pass filter circuit LPF2, an analog-to-digital converter (ADC) 261 and an OR gate 262, wherein the ADC 261 is, for example, a 4 bits ADC. If the duty cycle of the dimming signal Sdim is 1/4, the ADC 261 outputs "0100", which is "0100 0000" in a digital type. The predetermined value is "0010 0000" in the digital type.

According to the above description, as long as one of the front three highest bits has a value of 1, it is considered to be greater than the predetermined value, so that an OR operation can be performed to the front three highest bits to generate the dimming mode signal Smod. After the OR gate 262 operates the front three highest bits of "0100 0000" output by the ADC 261, the dimming mode signal Smod with a high logic level is generated, which represents that the duty cycle of the dimming signal Sdim is greater than the predetermined value. Thereafter, the multiplexer 271 outputs "0100 0000" transmitted from the ADC 261 to a duty cycle to voltage converter 276 according to the dimming mode signal Smod, so as to convert the digital type "0100 0000" into an analog type and output it as the control voltage Vcol, wherein the duty cycle to voltage converter 276 can include a digital-to-analog converter (DAC) for converting the digital type "0100 0000" into the analog type. Moreover, when the disperse delay unit 275 does not receive the output of the ADC 261, it can correspondingly generate a plurality of the control signals Scol to simultaneously conduct the switches SW1-SWn.

If the duty cycle of the dimming signal Sdim is 1/16, the ADC 261 outputs "0001 0000", and after the OR gate 262 operates the front three highest bits thereof, the dimming mode signal Smod with a low logic level is generated. Thereafter, the multiplexer 271 outputs "0001 0000" transmitted from the ADC 261 to the duty cycle to voltage converter 276 according to the dimming mode signal Smod. Now, the disperse delay unit 275 correspondingly generates a plurality of the control signals Scol to control the switches SW1-SWn to be respectively conducted during one period. Moreover, the disperse delay unit 275 regulates the output "0001 0000" of the ADC 261 according to the predetermined value, i.e. "0001 0000" is multiplied by 8 (which is equivalent to left-shift three bits) to obtain "1000 0000". Taking "1000 0000" as the gain signal, the duty cycle to voltage converter 276 converts "1000 0000" into an analog type and outputs it as the control voltage Vcol. It should be noticed that in the present embodiment, the duty cycle to voltage converter 276 does not receive the dimming signal Sdim, so as to reduce a complexity of a circuit design.

Figure 3A:
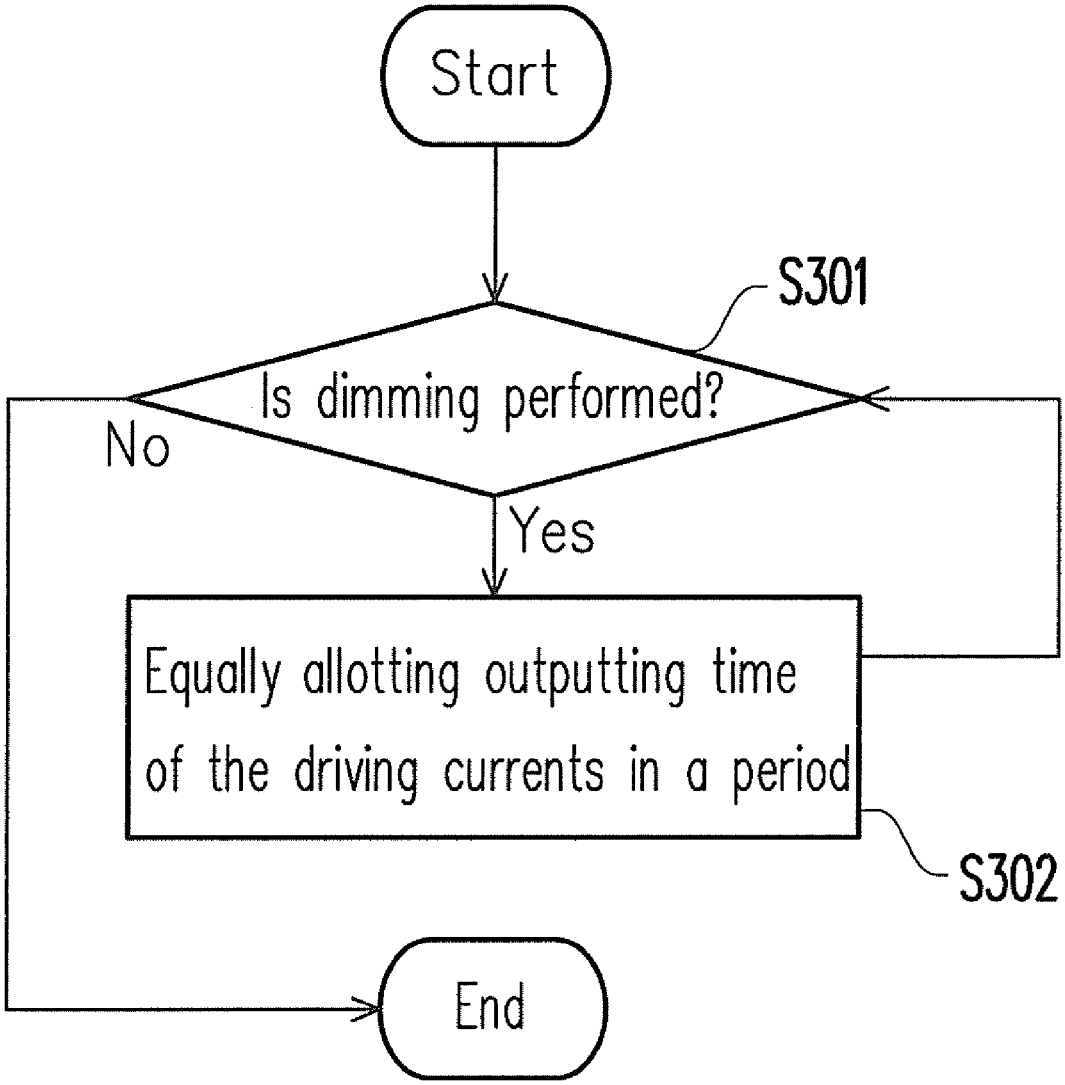
FIG. 3A is a flowchart illustrating a driving method according to an embodiment of the present invention.

According to the above description, a driving method for the driving apparatus 200 can be deduced. FIG. 3A is a flowchart illustrating a driving method according to an embodiment of the present invention. Referring to FIG. 2A and FIG. 3A, the driving apparatus 200 receives the dimming signal Sdim, and whether the driving apparatus 200 performs the dimming can be detected according to the dimming signal Sdim (step S301). When the driving apparatus 200 performs the dimming, the outputting time of the driving currents $I_1$-$I_n$ are equally allotted in a period (step S302), and the driving apparatus 200 can output the driving currents $I_1$-$I_n$ to respectively drive the LED strings 50_1-50_*n*. When the driving apparatus 200 does not perform the dimming, the driving method is ended.

Figure 3B:
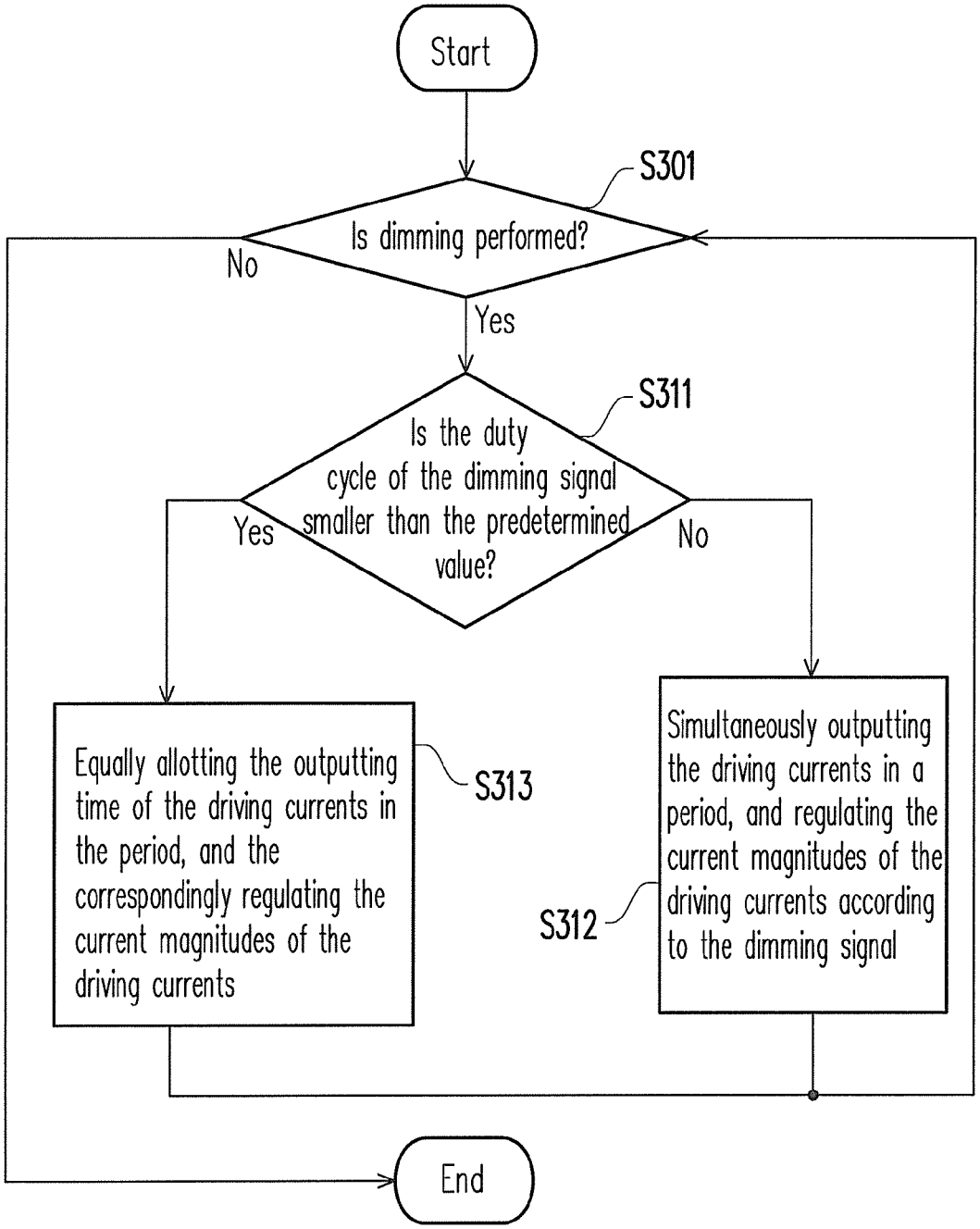
FIG. 3B is a flowchart illustrating a driving method according to another embodiment of the present invention.

FIG. 3B is a flowchart illustrating a driving method according to another embodiment of the present invention. Referring to FIG. 3A and FIG. 3B, a difference there between lies in steps S311, S312 and S313. When the driving apparatus performs the dimming, it is determined whether the duty cycle of the dimming signal is smaller than the predetermined value (step S311). If the duty cycle of the dimming signal is not smaller than the predetermined value, the driving currents are simultaneously output during the period, and the current magnitudes of the driving currents are regulated according to the dimming signal (step S312). If the duty cycle of the dimming signal is smaller than the predetermined value, the outputting time of the driving currents are equally allotted in the period, and the current magnitudes of the driving currents are correspondingly regulated (step S313). Wherein, the aforementioned embodiments can be referred for the steps S312 and S313, and therefore detailed descriptions thereof are not repeated.

In summary, according to the driving apparatus of the LED of the present invention and the driving method thereof, when the driving apparatus performs the dimming and the duty cycle of the dimming signal is smaller than the predetermined value, the outputting time of the driving currents are equally allotted in the period, and the current magnitude of each of the driving currents is correspondingly regulated. When the driving apparatus performs the dimming and the duty cycle of the dimming signal is equal to or greater than the predetermined value, the driving currents are simultaneously output in the period, and the current magnitude of each of the driving currents is regulated according to the dimming signal. By such means, the audio noise and the EMI caused by excessive variation of a sum of the driving currents are suppressed.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A driving method of a light-emitting diode (LED), adapted to a driving apparatus, the driving method comprising:

receiving a dimming signal;

equally allotting outputting time of a plurality of driving currents in a period when the driving apparatus performs dimming according to the dimming signal; and outputting the driving currents to respectively drive a plurality of LEDs.

2. The driving method of the LED as claimed in claim 1, wherein the step of equally allotting the outputting time of the driving currents in the period comprises:

equally allotting the outputting time of the driving currents in the period and correspondingly regulating a current magnitude of each of the driving currents when the driving apparatus performs dimming and a duty cycle of the dimming signal is smaller than a predetermined value.

3. The driving method of the LED as claimed in claim 2, further comprising:

simultaneously outputting the driving currents in the period and regulating a current magnitude of each of the driving currents according to the dimming signal when the driving apparatus performs dimming and a duty cycle of the dimming signal is greater than or equal to the predetermined value.

4. The driving method of the LED as claimed in claim 2, wherein the predetermined value is a ratio between the period and a number of the driving currents.

5. The driving method of the LED as claimed in claim 1, wherein the driving currents are sequentially output in turn.

6. The driving method of the LED as claimed in claim 1, wherein the driving currents are output in turn according to a random sequence.

7. A driving apparatus of an LED, comprising:

a current driving unit, outputting a plurality of driving currents to respectively drive a plurality of LEDs;

a plurality of switches, respectively coupled between the current driving unit and the LEDs for controlling whether or not to output the driving currents to the LEDs;

a dimming detector, receiving a dimming signal, and detecting whether the driving apparatus performs dimming according to the dimming signal, so as to output a dimming mode signal; and a current control unit, coupled to the dimming detector and the switches, and controlling conducting time of the switches to be equivalent in a period and equally divide the period according to the dimming mode signal when the driving apparatus performs dimming.

8. The driving apparatus of the LED as claimed in claim 7, wherein the dimming detector further generates the dimming mode signal according to whether a duty cycle of the dimming signal is smaller than a predetermined value.

9. The driving apparatus of the LED as claimed in claim 8, wherein the predetermined value is a ratio between the period and a number of the driving currents.

10. The driving apparatus of the LED as claimed in claim 8, wherein the current control unit is further coupled to the current driving unit for controlling the conducting time of the switches to be equivalent in the period and equally divide the period according to the dimming mode signal, and controlling the current driving unit to regulate current magnitudes of the driving currents when the driving apparatus performs dimming and the duty cycle of the dimming signal is smaller than the predetermined value; and for controlling the switches to be simultaneously conducted in the period according to the dimming mode signal, and controlling the current driving unit to regulate the current magnitudes of the driving currents according to the dimming signal when the driving apparatus performs dimming and the duty cycle of the dimming signal is greater than or equal to the predetermined value.

11. The driving apparatus of the LED as claimed in claim 10, wherein the current control unit comprises:

a multiplexer, coupled to the dimming detector for receiving the dimming mode signal, wherein an input terminal of the multiplexer receives the dimming signal, and whether a first output terminal or a second output terminal thereof outputs the dimming signal is determined according to the dimming mode signal;

a disperse delay unit, coupled to the first output terminal of the multiplexer and the switches, wherein when the dimming signal is received, the disperse delay unit controls conducting time of the switches to be to be equivalent in the period and equally divide the period, and outputs the dimming signal and a gain signal, and when the dimming signal is not received, the disperse delay unit controls the switches to be simultaneously conducted in the period; and a duty cycle to voltage converter, coupled to the second output terminal of the multiplexer, the disperse delay unit and the current driving unit, wherein when the dimming signal is received, the duty cycle to voltage converter regulates a current magnitude of the driving current according to the dimming signal, and when the dimming signal and the gain signal are received, the duty cycle to voltage converter regulates a current magnitude of the driving current according to the dimming signal and the gain signal.

12. The driving apparatus of the LED as claimed in claim 11, wherein the duty cycle to voltage converter comprises:

a low pass filter, coupled to the multiplexer and the disperse delay unit; and an analog multiplier, coupled to the low pass filter, the disperse delay unit and the current driving unit, for regulating an output voltage of the low pass filter according to the gain signal, and outputting a regulated result to the current driving unit.

13. The driving apparatus of the LED as claimed in claim 10, wherein the current driving unit comprises:

a plurality of voltage-controlled current sources, commonly coupled to the current control unit.

14. A driving method of LED, adapted to a driving apparatus, the driving apparatus receiving a dimming signal, and outputting a plurality of driving currents to respectively drive a plurality of LEDs, the driving method comprising:

detecting whether the driving apparatus performs dimming;

equally allotting outputting time of the driving currents in a period, and correspondingly regulating a current magnitude of each of the driving currents when the driving apparatus performs dimming and a duty cycle of the dimming signal is smaller than a predetermined value; and simultaneously outputting the driving currents in the period, and regulating a current magnitude of each of the driving currents according to the dimming signal when the driving apparatus performs dimming and the duty cycle of the dimming signal is equal to or greater than the predetermined value.

15. The driving method of the LED as claimed in claim 14, wherein the predetermined value is a ratio between the period and a number of the driving currents.

16. The driving method of the LED as claimed in claim 14, wherein the driving currents are sequentially output in turn.

17. The driving method of the LED as claimed in claim 14, wherein the driving currents are output in turn according to a random sequence.

18. A driving apparatus of an LED, comprising:

a current driving unit, outputting a plurality of driving currents to respectively drive a plurality of LEDs;

a plurality of switches, respectively coupled between the current driving unit and the LEDs for controlling whether or not to output the driving currents to the LEDs;

a dimming detector, receiving a dimming signal, and detecting whether the driving apparatus performs dimming and whether a duty cycle of the dimming signal is smaller than a predetermined value according to the dimming signal, so as to output a dimming mode signal; and a current control unit, coupled to the dimming detector, the switches and the current driving unit, wherein when the driving apparatus performs dimming and the duty cycle of the dimming signal is smaller than the predetermined value, the current control unit controls conducting time of the switches to be equivalent in a period and equally divide the period according to the dimming mode signal, and controls the current driving unit to regulate a current magnitude of each of the driving currents, and when the driving apparatus performs dimming and the duty cycle of the dimming signal is equal to or greater than the predetermined value, the current control unit controls the switches to be simultaneously conducted in the period according to the dimming mode signal, and controls the current driving unit to regulate a current magnitude of each of the driving currents according to the dimming signal.

19. The driving apparatus of the LED as claimed in claim 18, wherein the current control unit comprises:

a multiplexer, coupled to the dimming detector for receiving the dimming mode signal, wherein an input terminal of the multiplexer receives the dimming signal, and whether a first output terminal or a second output terminal thereof outputs the dimming signal is determined according to the dimming mode signal;

a disperse delay unit, coupled to the first output terminal of the multiplexer and the switches, wherein when the dimming signal is received, the disperse delay unit controls conducting time of the switches to be to be equivalent in the period, and outputs the dimming signal and a gain signal, and when the dimming signal is not received, the disperse delay unit controls the switches to be simultaneously conducted in the period; and a duty cycle to voltage converter, coupled to the second output terminal of the multiplexer, the disperse delay unit and the current driving unit, wherein when the dimming signal is received, the duty cycle to voltage converter regulates a current magnitude of the driving current according to the dimming signal, and when the dimming signal and the gain signal are received, the duty cycle to voltage converter regulates a current magnitude of the driving current according to the dimming signal and the gain signal.

20. The driving apparatus of the LED as claimed in claim 19, wherein the duty cycle to voltage converter comprises:

a low pass filter, coupled to the multiplexer and the disperse delay unit; and an analog multiplier, coupled to the low pass filter, the disperse delay unit and the current driving unit, for regulating an output voltage of the low pass filter according to the gain signal, and outputting a regulated result to the current driving unit.

21. The driving apparatus of the LED as claimed in claim 19, wherein the current driving unit comprises:

a plurality of voltage-controlled current sources, commonly coupled to the duty cycle to voltage converter.

22. The driving apparatus of the LED as claimed in claim 18, wherein the predetermined value is a ratio between the period and a number of the driving currents.

* * * * *